United States Patent [19]

West

[11] 4,444,648

[45] Apr. 24, 1984

[54] SOLVENT DEWAXING WITH METHYL TERTIARY BUTYL ETHER

[75] Inventor: Theodore H. West, Sarnia, Canada

[73] Assignee: Exxon Research and Engineering Co., Florham Park, N.J.

[21] Appl. No.: 356,092

[22] Filed: Mar. 8, 1982

[51] Int. Cl.³ ..... C10G 73/06

[52] U.S. Cl. ..... 208/33

[58] Field of Search ..... 208/33

[56] References Cited

U.S. PATENT DOCUMENTS

| | | | |
|---|---|---|---|
| 2,191,136 | 2/1940 | Tijmstra et al. | 196/18 |
| 2,229,658 | 1/1941 | Jenkins | 196/18 |
| 2,608,517 | 8/1952 | Tiedje | 208/33 |
| 2,625,502 | 1/1953 | Backlund et al. | 208/33 |
| 2,723,220 | 4/1950 | Axe | 196/19 |
| 2,915,449 | 12/1950 | Doorn et al. | 208/29 |
| 3,239,445 | 3/1966 | Leonard et al. | 208/33 |
| 3,764,517 | 10/1973 | Bodemuller, Jr. | 208/33 |
| 3,871,991 | 3/1975 | Shaw | 208/33 |
| 4,111,790 | 9/1978 | West | 208/33 |
| 4,115,241 | 9/1978 | Harrison et al. | 208/33 |
| 4,146,461 | 3/1979 | Broadhurst et al. | 208/33 |

FOREIGN PATENT DOCUMENTS

| | | |
|---|---|---|
| 464175 | 4/1937 | United Kingdom . |
| 679173 | 9/1952 | United Kingdom . |
| 1311400 | 3/1973 | United Kingdom . |

*Primary Examiner*—Delbert E. Gantz
*Assistant Examiner*—Glenn A. Caldarola
*Attorney, Agent, or Firm*—Joseph J. Allocca

[57] ABSTRACT

A process is disclosed for the solvent dewaxing of wax containing hydrocarbon oils, preferably waxy petroleum oils most preferably waxy lubricating or transformer oils. The process employs methyl tertiary butyl ether as the dewaxing solvent, either alone or in combination with other dewaxing solvents such as ketones, halogenated hydrocarbon anti-solvents, and mixtures thereof. The use of methyl tertiary butyl ether as a dewaxing solvent, or in combination with conventional dewaxing anti-solvents permits lower volumes of solvent to be employed in the dewaxing process while simultaneously producing an oil of lower wax content and lower dewaxed oil pour point at the same filter temperature as that commonly employed using conventional dewaxing solvents. Dewaxed oil yields for equivalent pour point are 3 to 4% higher with the MTBE system.

11 Claims, 2 Drawing Figures

OIL IN SOLVENT MISCIBILITY CHARACTERISTICS OF MTBE ARE IDENTICAL TO TOLUENE

DEWAXED OIL YIELD VS SOLVENT USAGE COMPARISONS FOR EQUIVALENT WAX REMOVAL AND DEWAXED OIL POUR

SOLVENT DEWAXING WITH METHYL TERTIARY BUTYL ETHER

BACKGROUND OF THE INVENTION

In order for hydrocarbon oils, particularly lube and transformer oils derived from petroleum oil distillates, to function effectively as lubricants or insulators under low temperature conditions, it is essential that the oils be free from wax. In the industry this dewaxing is conducted employing a variety of processes, the simplest being a reduction in temperature of the oil in question until the wax therein crystallize or solidifies at which point it can be removed from the oil by suitable separation procedures, such as filtration, centrifugation, etc. This procedure works well for light oils, but heavier oil distillates, bright stocks or residuum require solvent dilution in order to be dewaxed to a low enough pour point while retaining sufficient fluidity to facilitate handling. Typical solvents used in these solvent dewaxing processes include ketones, aromatic hydrocarbons, halogenated hydrocarbons and mixtures thereof. This solvent dewaxing can be practiced in a number of ways. It is well known that wax-containing petroleum oil stocks can be dewaxed by shock chilling with a cold solvent. It is also known that shock chilling, in itself, results in a low filtration rate of the dewaxed oil from the resultant wax/oil-solvent slurry. Because of this, the conventional method of solvent dewaxing wax-containing petroleum oil stocks has been cooling in scraped surface heat exchangers using an incremental solvent addition technique. In this technique, the dewaxing solvent is added at several points along the chilling apparatus. The waxy oil is chilled without solvent until some wax crystallization has occurred and the mixture is thickened considerably. The first increment of solvent is introduced at this point and cooling continues. Each incremental portion of solvent is added as necessary to maintain fluidity until the desired filtration temperature is reached at which point the remainder of the solvent required to obtain the proper viscosity of the mixture for filtration is added. In using this technique it is well known that the temperature of the incrementally added solvent should be the same as that of the main stream of oil at the point of addition to avoid the shock chilling effect.

Alternatively, the waxy oil can have cold solvent mixed with it and thereby be chilled to the wax separation temperature. A preferred embodiment of this direct dilution chilling procedure is described in U.S. Pat. No. 3,773,650. The procedure described therein, referred to as DILCHILL, avoids the adverse effects of shock chilling by introducing the waxy oil into a staged chilling zone and passing the waxy oil from stage to stage of the zone, while at the same time injecting cold dewaxing solvent into a plurality of the stages and wherein a high degree of agitation is maintained in the stages so as to effect substantially instanteous mixing of the waxy oil and solvent. As the waxy oil passes from stage to stage of the cooling zone, it is cooled to a temperature sufficiently low to precipitate wax therefrom without incurring the shock chilling effect. This produces a wax/oil-solvent slurry wherein the wax particles have a unique crystal structure which provides superior filtering characteristics such as high filtration rates of the dewaxed oil from the wax and high dewaxed oil yields.

SUMMARY OF THE INVENTION

Figure 1:
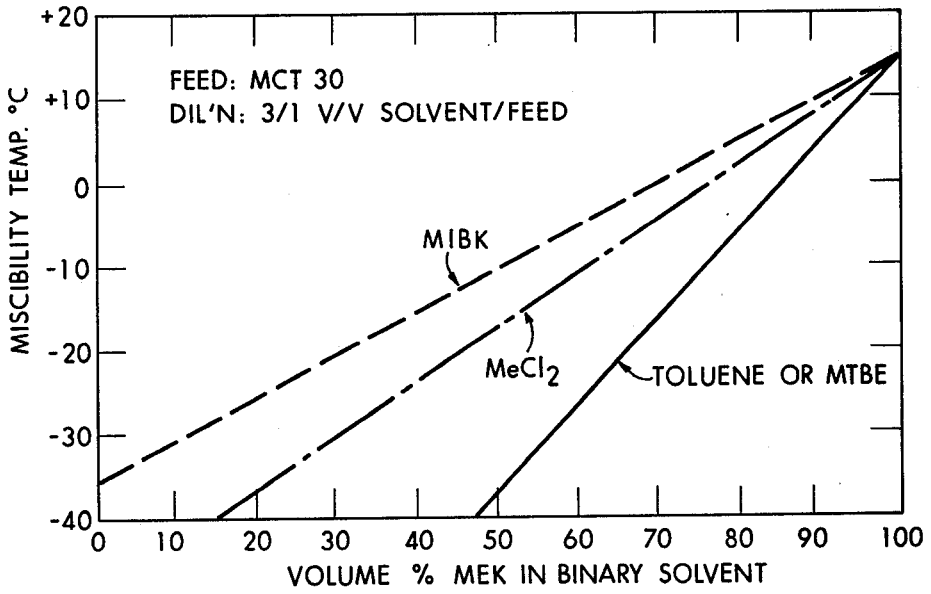
FIG. 1 presents the oil in solvent miscibility characteristics of various solvents.

It has been discovered, and forms the basis of the present invention that waxy hydrocarbon oils, particularly waxy petroleum oils, most particularly waxy lubricating oil stock or transformer oil stocks can be efficiently dewaxed using methyl tertiary butyl ether as the dewaxing solvent, either alone or in combination with conventional oil antisolvent dewaxing solvents such as the ketones, halogenated hydrocarbon anti-solvents and mixtures thereof, previously described.

The process of the present invention comprises dewaxing a waxy oil by contacting the waxy oil with the methyl tertiary butyl ether, either alone or in combination with conventional dewaxing solvents, and chilling the mixture to the desired wax separation temperature. Alternatively, the waxy oil may be contacted with a quantity of methyl tertiary butyl ether, either alone or in combination with conventional dewaxing anti-solvents, which MTBE (and the additional solvent, if any) has been prechilled to a low temperature. The most preferred embodiment employing cold MTBE (again, either alone or in combination with other dewaxing solvents which act as anti-solvents) would be in a direct chilling process employing direct chilling means whereby the cold MTBE solvent would be injected along a number of stages in the direct chilling means, a number of said stages being highly agitated thereby insuring substantially instantaneous mixing of the waxy oil and the cold MTBE solvent thereby avoiding shock chilling of the oil. U.S. Pat. No. 3,773,650 to Exxon Research and Engineering Company, previously identified and hereby incorporated by reference, describes the DILCHILL dewaxing process, a high agitation cold solvent direct contact chilling procedure.

By the practice of the present invention employing methyl tertiary butyl ether as the dewaxing solvent, the solvent dewaxing of waxy oil is improved in that less solvent is required to achieve a greater degree of wax removal and a lower dewaxed oil pour point at the same filter temperature (wax separation temperature) as is commonly employed when using conventional dewaxing solvents.

The efficiency of the solvent system is dependent on several factors namely:

(a) polarity, which determines its effectiveness as a crystallization medium;

(b) wax solubility, which determines the pour-filter temperature spread;

(c) viscosity, which determines the amount of solvent required to reduce filtrate viscosity for maximum throughput;

(d) thermal properties, which determine energy required for solvent recovery and cooling.

The properties of the conventional solvents and MTBE are presented in Table 1. The first two solvents, MEK and acetone, are classed as antisolvents (low oil solubility) while the remainder are classed as prosolvents (high oil solubility). MTBE has the lowest viscosity of the prosolvents with a much lower boiling point than either MIBK or toluene.

When used as a replacement for MIBK or toluene in combination with MEK, it has been found that up to 20% less solvent is required to achieve an equivalent yield and improved reduced pour point. This is readily apparent from Example 3 and FIG. 2. Similarly, holding solvent volumes and pour point constant evidences a 3–4% dewaxed oil yield advantage when employing MTBE as the pro-solvent in place of other typically employed prosolvents. Reference to Table 3 reveals that the use of MTBE results in a 4° C. pour point advantage for an equivalent dewaxing temperature, and at a lower solvent requirement.

As previously stated the dewaxing process may not only employ MTBE as such but preferably employs MTBE in combination with conventional dewaxing anti-solvents. Typical conventional dewaxing anti-solvents include ketones of from 3 to 6 carbon atoms such as acetone, dimethyl ketone, methylethyl ketone, methylpropyl ketone, methylisobutyl ketone (depending upon the feed stock, MIBK can function as an anti-solvent), etc., halogenated hydrocarbons which act as anti-solvents such as ethylene dichloride, etc., and mixtures of such conventional dewaxing solvents. Other solvents which may be employed in combination with MTBE include methanol and N-methyl pyrrolidone. When used in combination with such conventional dewaxing solvents, the methyl tertiary butyl ether should be present in a ratio which lowers the solvent/oil miscibility temperature to a temperature below the expected filtration temperature for a miscible operation. The conventional dewaxing solvent which may be mixed with the MTBE should be an anti-solvent, i.e. low oil solubility since MTBE behaves as a pro-solvent. It is common when employing solvent pairs or combinations of solvents in dewaxing application to use an anti-solvent in combination with a pro-solvent to achieve the proper balance of oil dilution, wax solubility and wax insolubility to facilitate wax separation.

The preferred solvent pair mixture is MEK/MTBE as shown in Table 3. It is a straight substitution of MTBE for Toluene in conventional MEK/Toluene mixtures as is seen from the fact that MTBE has the same miscibility characteristic as toluene.

TABLE 1

SOLVENT PROPERTIES

| Solvent | (a) Polarity: Dipole Moment | (a) Polarity: Dielectric Constant 20° C. | (b) Wax Solubility At 20° C. g of 126° F. mp wax/100 ml solvent | (c) Viscosity: cS at 0° C. | (c) Viscosity: cP at 0° C. | (c) Viscosity: Density 20° C. | (d) Thermal: Average Specific Heat Cal/g | (d) Thermal: Latent Heat of Vaporization Cal/g | (d) Thermal: BP 20° C. |
|---|---|---|---|---|---|---|---|---|---|
| MEK | 3.18 | 18.5 | 0.25 | 0.4 | 0.5 | 0.8 | 0.55 | 106 | 79.6 |
| Acetone | 2.89 | 20.7 | 0.05 | 0.32 | 0.4 | 0.79 | 0.518 | 124.6 | 56.1 |
| MIBK | 2.7 | 13.1 | 0.9 | 0.6 | 0.75 | 0.8 | 0.46 | 86.5 | 115.9 |
| Toluene | 0.36 | 2.4 | 13 | 0.61 | 0.7 | 0.87 | 0.41 | 98.5 | 110.6 |
| Methylene Chloride | 1.5 | 9.08 | 1.6 | 0.66 | 0.5 | 1.32 | 0.28 | 78.7 | 39.8 |
| Methyl Tertiary Butyl Ether | 1.23 | 4.5 | 7 | 0.31 | 0.42 | 0.74 | 0.51 | 77 | 55 |

The oils which may be subjected to such solvent dewaxing using MTBE include any of the typical waxy hydrocarbon oils including waxy synthetic oils derived from sources such as coal, shale oil, tar sands etc., and petroleum oil stock or distillate fraction. In general, these oil stocks or distillate fractions will have a boiling range within the broad range of about 500° F. to about 1300° F. The preferred oil stocks are the lubricating oil and specialty oil fractions boiling within the range of 550° F. and 1200° F. However, residual waxy oil stocks and bright stocks having an initial boiling point of above about 800° F. and containing at least about 10 wt.% of material boiling above about 1050° F. may also be used in the process of the instant invention. These fractions may come from any source, such as the paraffinic crudes obtained from Aramco, Kuwait, the Pan Handle, North Louisiana, naphthenic crudes such as Coastal Crudes, Tia Juana, mixed crudes such as Mid-Continent, etc., as well as the relatively heavy feed stocks such as bright stocks having a boiling range of 1050° F.+ and synthetic feed stocks derived from Athabascar tar sands, etc.

The solvent dewaxing process of the present invention employing MTBE typically employs from 1 to 6 volumes of solvent per volume of oil to be treated, preferably 1.5 to 4 volume of solvent per volume waxy oil.

EXAMPLE 1

Oil in solvent miscibility characteristics have been investigated for the MEK/MTBE, MEK/MIBK, MEK/$MeCl_2$ systems and the MEK/toluene system for 600 N oil of a dilution of 3/1 V/V solvent/feed. As can be seen from FIG. 1, the MEK/MTBE and MEK/Toluene systems are identical in this respect.

EXAMPLE 2

Wax solubility comparisons have been run between MEK/MTBE and MEK/toluene on 600 N oil feedstock. Waxy oil and solvent are heated above the solution cloud point in a wide mouth erlenmeyer flask equipped with thermometer and rubber stopper. The mixture is chilled with continuous stirring to the required filtration temperature. The mixture is transferred to a jacketed Buchner filter using No. 41 Whatman filter paper and vacuum filtered without solvent wash to a dry cake. The wax cake is quantitatively transferred to the Erlenmeyer flask and solvent from both the wax cake and filtrate are evaporated with air purge on a steam bath. A complete material balance is carried out on the feed and products to arrive at the theoretical % wax removed. Dewaxed oil from the filtrate is tested for pour point using a Mectron Autopour. Solvent constituents composition was similar being 60/40 v/v but a lower dilution ratio was used for the MEK/MTBE system as compared to the MEK/toluene system. The data is presented in Table 2.

TABLE 2

WAX SOLUBILITY COMPARISON BETWEEN MEK/MTBE AND MEK/TOLUENE

| Feed | Baytown 600 Neutral | |
|---|---|---|
| Solvent | 60/40 v/v MEK/MTBE | 60/40 v/v MEK/Toluene |
| Solvent/Feed Dilution v/v | 2.0 | 3.0 |
| % Wax Removed | 18 | 17 |
| Filter Temp, °C. | −18 | −18 |
| Dewaxed Oil Autopour °C. | −14.5 | −12.5 |
| Pour-Filter Δ T °C. | 3.5 | 5.5 |

As is seen, even with the substantially lower dilution ratios employed for the MEK/MTBE system the % wax removed was slightly improved, as was the dewaxed oil pour point taken at equivalent filter temperatures. The pour point more closely approached the filter temperature for the MEK/MTBE system than for the MEK/toluene system. This surprising result permits the use of less solvent while achieving equivalent or superior results respecting pour point.

EXAMPLE 3

A performance comparison was conducted between MEK/MTBE and MEK/Toluene on 600 N oil employing the dilution chilling procedure.

In this example, experiments were run utilizing a single stage dilution chilling dewaxing laboratory batch unit which, while not completely duplicating continuous multistage operation, has been found to give results approximately equivalent to those obtained with continuous, commercial multistage operations. The unit contained a flat-bladed propeller and a solvent injection tube with a recycle loop. Experiments were conducted by filling the unit with the waxy oil to be chilled at just above its cloud point. After the unit was filled with the waxy oil, the impeller was started along with simultaneous injection of chilled solvent into the waxy oil at the impeller tip. The solvent was injected continuously, but at incrementally increased flow rates for a total of 17 successive incremental increases in flow rate in order to simulate a 17 stage dilution chilling dewaxing tower. Following the addition of the desired volume of cold dewaxing solvent the slurry from the unit was then scrape surface chilled at an average rate of about 2° F. per minute until a filtration temperature of 0° F. (−18° C.) was reached. The filter rate and the waxy oil yield as well as the wax cake liquid/solid ratio were determined by filtering the cold, diluted waxy slurry through a laboratory filter leaf calibrated to simulate a rotary filter operation, followed by washing the wax cake on the filter with additional dewaxing solvent at the filtration temperature.

Two dewaxing solvents were used in this example. One was a 60/40 V% mixture of MEK/MTBE and the other was 60/40 LV% mixture of MEK/Toluene, the solvents being precooled to −20° F. (−29° C.). The feed stock was a 600 N raffinate (see Example 2 for description). The waxy oil added to the unit was at a temperature of about 126° F. The volumetric ratio of dewaxing solvent to the feed, the volumetric ratio of the wash solvent (wax cake) to the feed, total solvent used, feed filter rate and wax oil content are shown in Table 3.

TABLE 3

DILCHILL DEWAXING PERFORMANCE COMPARISONS BETWEEN MEK/MTBE AND MEK/TOLUENE

| Feed | Baytown, 600 Neutral | | | |
|---|---|---|---|---|
| Filter Temp, °C. | 18 | | | |
| DILCHILL Solvent Temp, °C. | 29 | | | |
| Wash Time = Filter time | | | | |
| Solvent | MEK/MTBE 60/40 v/v | | MEK/Toluene 60/40 v/v | |
| Solvent/Feed v/v | | | | |
| Dilution v/v | 1.6 | 2.6 | 1.5 | 3.2 |
| Wash Solvent v/v | 0.4 | 0.9 | .4 | 1.5 |
| Total Solvent | 2.0 | 3.5 | 1.9 | 4.7 |
| Feed Filter Rate | | | | |
| $m^3/m^2 \cdot$ day | 4.7 | 5.1 | 4.7 | 4.9 |
| Wax Cake Liquids/Solids | 5.8 | 6.4 | 5.8 | 6.2 |
| % Oil in Wax | 52 | 28 | 57 | 9.5 |
| Dewaxed Oil Yield wt % | 64.4 | 76.8 | 64.7 | 83.2 |
| DWO Filter Rate | | | | |
| $m^3/m^2 \cdot$ day | 3.17 | 3.99 | 3.03 | 4.05 |
| Pour Point ° C. | −13 | −12 | −9 | −8 |
| Dewaxed Oil Yield wt % for −9° C. Pour Point | 68.3 | 79 | 64.7 | 83 |

As can be seen, good feed filter rates, dewaxed oil filter rates and dewaxed oil yields are achieved. The most significant advantage is a 4° C. benefit in pour-filter ΔT i.e. for equivalent pour point, dewaxing temperatures would be 4° C. higher with MEK/MTBE than with MEK/Toluene.

Figure 2:
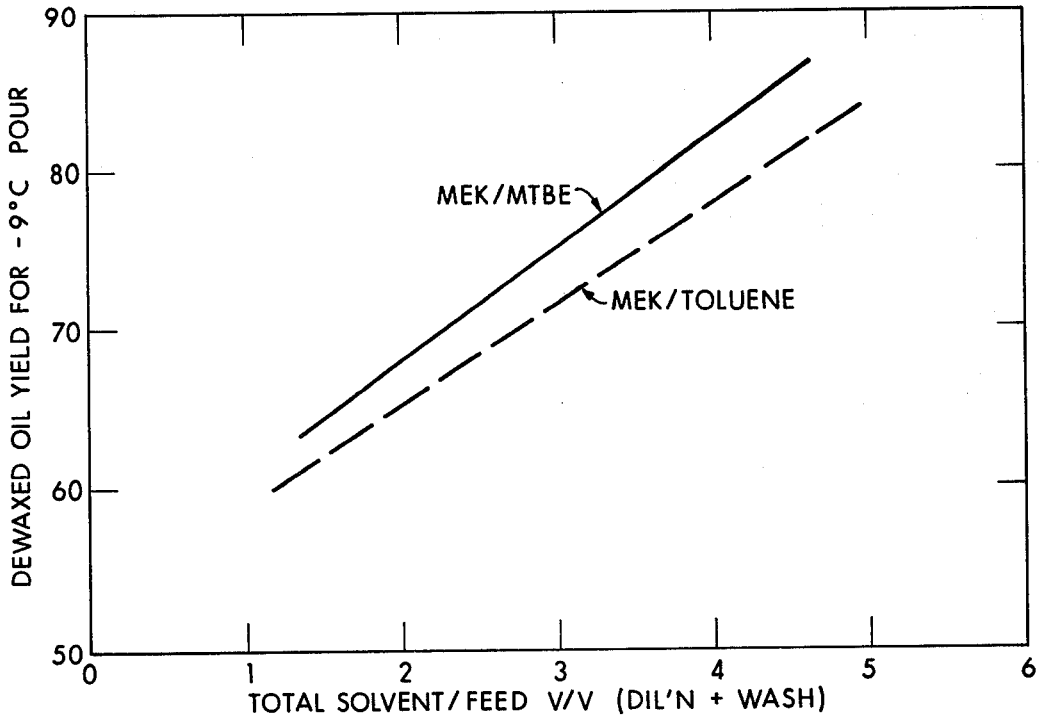
FIG. 2 compares the dewaxed oil yield (at −9° C. pour) versus total solvent for the systems MEK/Toluene and MEK/MTBE.

If the dewaxed oil yield is normalized for a −9° C. pour (−9° C. being the specification for a 600 N oil [a 30 grade oil]) we see from FIG. 2 that MEK/MTBE provides a 3–4% dewaxed oil yield advantage over MEK/Toluene for equivalent pour level and solvent usage.

What is claimed is:

1. In a solvent dewaxing process wherein a waxy hydrocarbon oil is mixed with a dewaxing solvent and chilled to form a slurry comprising solid particles of wax and a mixture of dewaxed oil and solvent, the improvement which comprises using as the dewaxing solvent methyl tertiary butyl ether.

2. In a solvent dewaxing process wherein a waxy hydrocarbon oil is mixed with a dewaxing solvent and chilled to form a slurry comprising solid particles of wax and a mixture of dewaxed oil and solvent, the improvement which comprises using as the dewaxing solvent a solvent selected from the group consisting of mixtures of (a) methyl tertiary butyl ether with (b) an oil anti-solvent.

3. In a process for dewaxing a waxy hydrocarbon oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of solvent-containing stages so as to achieve substantially instantaneous mixing of the solvent-waxy oil mixture as it progresses from stage to stage through said chilling zone, thereby precipitating at least a portion of said wax from said oil under conditions of said high degree of agitation, separating the precipitated wax from the solvent-oil mixture and recovering an oil stock of reduced wax content from said mixture, the improvement which comprises using as the dewaxing solvent methyl tertiary butyl ether.

4. In a process for dewaxing a waxy hydrocarbon oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of solvent-containing stages so as to achieve substantially instantaneous mixing of the solvent-waxy oil mixture as it progresses from stage to stage through said chilling zone, thereby precipitating at least a portion of said wax from said oil under conditions of said high degree of agitation, separating the precipitated wax from the solvent-oil mixture and recovering an oil stock of reduced wax content from said mixture, the improvement which comprises using as the dewaxing solvent a solvent selected from the group consisting of mixtures of (a) methyl tertiary butyl ether with (b) an oil anti-solvent.

5. The process of claim 2 or 4 wherein the oil anti-solvent is selected from the group consisting of ketones of from 3 to 6 carbons, halogenated hydrocarbon anti-solvents and mixtures thereof.

6. The process of claim 2 or 4 wherein the oil anti-solvent is selected from the group consisting of methyl ethyl ketone, acetone, methanol, and N-methyl pyrrolidone.

7. The process of claim 2 or 4 wherein the methyl tertiary butyl ether is present in a ratio to the anti-solvent such that the solvent/oil miscibility temperature of the mixture is lowered to a temperature below the expected filtration temperature for a miscible operation.

8. The process of claim 6 wherein the methyl tertiary butyl ether is present in a ratio to the antisolvent such that the solvent/oil miscibility temperature of the mixture is lowered to a temperature below the expected filtration temperature for a miscible operation.

9. The method of claim 1, 3 or 4 wherein the waxy hydrocarbon oil stock is a petroleum oil fraction.

10. The method of claim 1, 3 or 4 wherein the waxy hydrocarbon oil stock is a lube oil fraction.

11. The method of claim 1, 3 or 4 wherein the dewaxing solvent is added in an amount such that the dilution ratio of the wax/solvent-dewaxed oil slurry ranges from about 1 to 6 volumes of solvent per volume waxy oil.

* * * * *

UNITED STATES PATENT AND TRADEMARK OFFICE

CERTIFICATE OF CORRECTION

PATENT NO. : 4,444,648

DATED : April 24, 1984

INVENTOR(S) : Theodore H. West

It is certified that error appears in the above—identified patent and that said Letters Patent is hereby corrected as shown below:

Column 6, line 5, before "18" insert -- - --.

Column 6, line 6, before "29" insert -- - --.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*